US008051583B2

(12) United States Patent
Roether et al.

(10) Patent No.: US 8,051,583 B2
(45) Date of Patent: Nov. 8, 2011

(54) ARTICLE OF FOOTWEAR WITH IMPROVED STABILITY AND BALANCE

(75) Inventors: Julia Roether, Portland, OR (US); Steven F. Smith, Lake Oswego, OR (US); Sean M. McDowell, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 876 days.

(21) Appl. No.: 11/851,119

(22) Filed: Sep. 6, 2007

(65) Prior Publication Data

US 2009/0064538 A1 Mar. 12, 2009

(51) Int. Cl.
*A43B 13/12* (2006.01)
*A43B 5/00* (2006.01)

(52) U.S. Cl. ..... 36/30 R; 36/117.3; 36/107; 36/108; 36/76 R

(58) Field of Classification Search ..... 36/30 R, 36/25 R, 75 R, 76 R, 107, 108, 117.3
See application file for complete search history.

(56) References Cited

U.S. PATENT DOCUMENTS

| | | | | | |
|---|---|---|---|---|---|
| 2,545,910 | A | * | 3/1951 | Aprile | 36/132 |
| 2,682,712 | A | * | 7/1954 | Owsen et al. | 36/107 |
| 3,100,354 | A | | 8/1963 | Lombard et al. | |
| 3,204,347 | A | * | 9/1965 | Snow | 36/107 |
| 3,613,270 | A | * | 10/1971 | Eie | 36/117.3 |
| 3,775,875 | A | * | 12/1973 | Dvorsky | 36/72 A |
| 4,186,500 | A | * | 2/1980 | Salzman | 36/117.2 |
| 4,246,708 | A | * | 1/1981 | Gladek | 36/107 |
| 4,259,792 | A | | 4/1981 | Halberstadt | |
| 4,271,607 | A | * | 6/1981 | Funck | 36/30 R |
| 4,358,904 | A | * | 11/1982 | Guild | 36/117.3 |
| 4,543,738 | A | * | 10/1985 | Mower | 36/117.3 |
| 4,813,162 | A | * | 3/1989 | Harris | 36/88 |
| 4,878,300 | A | * | 11/1989 | Bogaty | 36/35 R |
| 5,003,709 | A | * | 4/1991 | Okayasu et al. | 36/107 |

(Continued)

FOREIGN PATENT DOCUMENTS

DE 3741444 7/1988

(Continued)

OTHER PUBLICATIONS

Sauer—Shooting Sportswear website, Model, "Easy Style", Item No. 2022, <http://www.sauer-shootingsportswear.de/english/schuhe2.htm>, downloaded Feb. 5, 2007, 1 page.

(Continued)

*Primary Examiner* — Marie Patterson
(74) *Attorney, Agent, or Firm* — Plumsea Law Group, LLC

(57) ABSTRACT

The stability and balance offered by an article of footwear is improved by including a rigid layer in an outsole assembly of the article of footwear. The rigid layer may include a material of at least a predefined rigidity. For example, an outsole may be fitted with a carbon fiber plate that maintains the shape and a flatness of the outsole assembly. The rigid layer may be attached to one or more other layers that may be configured for impact force attenuation and comfort. In one or more arrangements, the rigid layer may be sandwiched between two other layers. Alternatively, the rigid layer may be insertable into a layer of the outsole. A channel may cut into a layer of the outsole to distribute weight to an outside portion of the outsole. This distribution of weight to the outside portion of the outsole may improve stability and balance.

15 Claims, 12 Drawing Sheets

U.S. PATENT DOCUMENTS

| | | | | |
|---|---|---|---|---|
| 5,005,299 | A | 4/1991 | Whatley | |
| 5,052,130 | A * | 10/1991 | Barry et al. | 36/107 |
| 5,220,735 | A * | 6/1993 | Raoul-Duval | 36/8.3 |
| 5,280,680 | A | 1/1994 | Burke et al. | |
| 5,295,314 | A * | 3/1994 | Moumdjian | 36/29 |
| 5,319,866 | A * | 6/1994 | Foley et al. | 36/91 |
| 5,325,611 | A * | 7/1994 | Dyer et al. | 36/30 R |
| 5,390,430 | A * | 2/1995 | Fitchmun et al. | 36/30 R |
| 5,572,805 | A * | 11/1996 | Giese et al. | 36/30 R |
| 5,611,152 | A * | 3/1997 | Richard et al. | 36/28 |
| 5,784,808 | A | 7/1998 | Hockerson | |
| D414,595 | S | 10/1999 | Bonnadieu et al. | |
| 5,996,257 | A * | 12/1999 | Harrison | 36/72 R |
| D426,054 | S | 6/2000 | Mazars | |
| 6,079,125 | A * | 6/2000 | Quellais et al. | 36/25 R |
| 6,167,639 | B1 * | 1/2001 | Ventura | 36/44 |
| 6,199,303 | B1 * | 3/2001 | Luthi et al. | 36/31 |
| 6,202,326 | B1 * | 3/2001 | Hauglin | 36/117.2 |
| 6,226,900 | B1 | 5/2001 | Mazars | |
| 6,321,469 | B1 * | 11/2001 | Cretinon | 36/102 |
| 6,625,905 | B2 * | 9/2003 | Kita | 36/30 R |
| 6,796,058 | B2 * | 9/2004 | Pochatko | 36/102 |
| 6,954,998 | B1 * | 10/2005 | Lussier | 36/107 |
| 6,968,637 | B1 * | 11/2005 | Johnson | 36/88 |
| D514,288 | S | 2/2006 | Burg | |
| 7,263,788 | B2 * | 9/2007 | Johnson | 36/91 |
| 2002/0092207 | A1 * | 7/2002 | Girard et al. | 36/117.3 |
| 2003/0200675 | A1 * | 10/2003 | Gross | 36/15 |
| 2005/0241187 | A1 | 11/2005 | Johnson | |
| 2006/0010716 | A1 | 1/2006 | Kerns et al. | |
| 2006/0143950 | A1 | 7/2006 | Beak | |
| 2007/0068039 | A1 | 3/2007 | Nau | |

FOREIGN PATENT DOCUMENTS

| | | |
|---|---|---|
| EP | 0377781 | 7/1989 |

OTHER PUBLICATIONS

Sauer—Shooting Sportswear website, Model, "Perfect Style", Item No. 2016, <http://www.sauer-shootingsportswear.de/english/schuhe1.htm>, downloaded Feb. 5, 2007, 1 page.

* cited by examiner

ARTICLE OF FOOTWEAR WITH IMPROVED STABILITY AND BALANCE

TECHNICAL FIELD

The invention relates generally to an article of footwear. Articles of footwear in accordance with at least some aspects include an outsole assembly having a rigid layer for maintaining the shape of the footwear and providing stability and balance.

BACKGROUND

A conventional article of athletic footwear includes two primary elements, an upper and a sole structure. The upper provides a covering for the foot that securely receives and positions the foot with respect to the sole structure. In addition, the upper may have a configuration that protects the foot and provides ventilation, thereby cooling the foot and removing perspiration. The sole structure is secured to a lower portion of the upper and is generally positioned between the foot and the ground. In addition to attenuating ground reaction forces (i.e., imparting impact force attenuation), the sole structure may provide traction and control foot motions, such as pronation. Accordingly, the upper and the sole structure operate cooperatively to provide a comfortable structure that is suited for a variety of ambulatory activities, such as walking and running.

The sole structure of athletic footwear generally exhibits a layered configuration that may include a comfort-enhancing insole, a resilient midsole formed from a polymer foam material, and a ground-contacting outsole that provides both abrasion-resistance and traction. In some athletic activities, an athlete may be required to establish a stable and balanced stance in order to achieve some goal. For example, in firearm based athletic events, having a stable and balanced position may affect the accuracy and overall performance of the athlete (i.e., increase in stability may provide an increase in accuracy). Current outsoles often use substantially flexible materials and configurations to provide comfort and impact force attenuation for the wearer. However, outsoles composed using such flexible materials and configurations are prone to deformation (e.g., due to a wearer's shift in weight) and thus, may cause instability in a wearer's stance.

It would be desirable to provide a footwear support system that reduces or overcomes some or all of the difficulties inherent in prior known devices. Particular objects and advantages will be apparent to those skilled in the art, that is, those who are knowledgeable or experienced in this field of technology, in view of the following disclosure of the invention and detailed description of certain embodiments.

SUMMARY

The principles of the invention may be used to provide an article of footwear having a stable and balanced outsole assembly. In accordance with a first aspect, an outsole assembly may include multiple layers. In particular, the outsole may include a plate layer comprising a rigid material having a predefined stiffness and thickness for maintaining the shape and configuration of the outsole. The outsole assembly may further include one or more additional layers such as a foam or rubber layer for shock absorption, comfort and the like. In one or more configurations, the outsole assembly may comprise a carbon fiber material having a sufficient stiffness to substantially resist flexion or bending of the outsole resulting from, e.g., a wearer's shift in weight.

In accordance with another aspect, the outsole assembly may be sized and configured to extend past a toe and/or heel point of a shoe upper to which the assembly is connected. Such a configuration may be used to allow a wearer to attach the shoe to a stretcher device that is configured to hold tension forcing the sole to be flat.

In accordance with yet another aspect, a bottom layer of the outsole assembly (i.e., the layer that would contact a walking surface), may include a channel for distributing weight to an outside portion of the outsole assembly. The channel may be positioned within a middle portion of the outsole where a wearer's weight, or a substantial portion thereof, is concentrated. The channel may be cut in a variety of shapes and sizes depending on the desired distribution of force in various directions. Further, the depth of the channel may depend on the thickness of the outsole assembly and/or whether a plate member such as a carbon fiber plate is present.

Advantages are achieved by providing an article of footwear with a rigid outsole assembly. In particular, certain embodiments allow an article of footwear to provide stability and balance. These and additional features and advantages disclosed here will be further understood from the following detailed disclosure of certain embodiments.

BRIEF DESCRIPTION OF THE DRAWINGS

A more complete understanding of the present invention and at least some advantages thereof may be acquired by referring to the following description in consideration of the accompanying drawings, in which like reference numbers indicate like features, and wherein.

Figure 1:
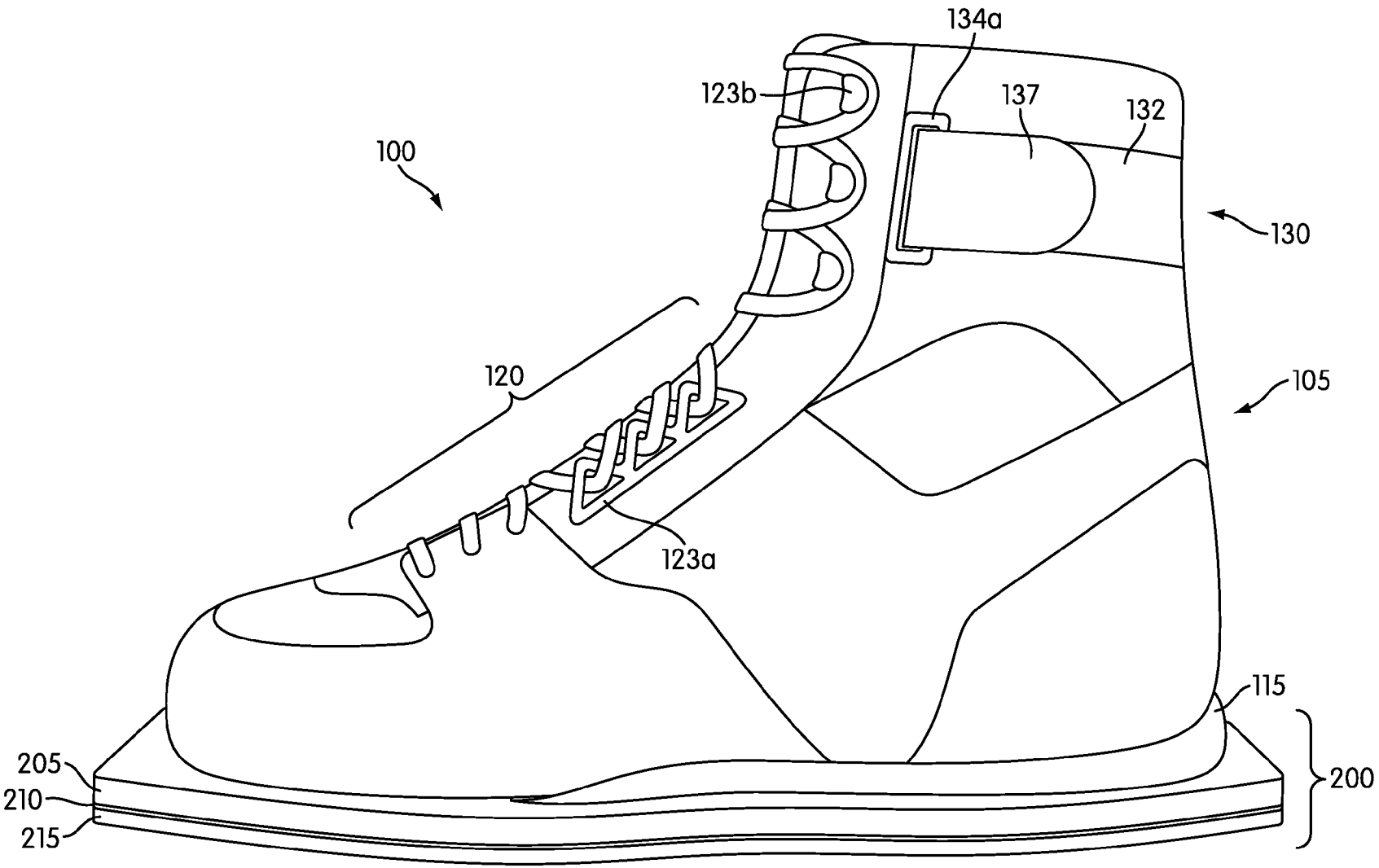
FIG. 1 is a lateral side view of an article of footwear with a rigid outsole assembly according to an embodiment.

The figures referred to above are not drawn necessarily to scale and should be understood to provide a representation of the invention, illustrative of the principles involved. Some features of the article of footwear depicted in the drawings have been enlarged or distorted relative to others to facilitate explanation and understanding. The same reference numbers are used in the drawings for similar or identical components and features shown in various alternative embodiments. Articles of footwear as disclosed herein would have configurations and components determined, in part, by the intended application and environment in which they are used.

DETAILED DESCRIPTION

In the following description of various examples of the present invention, reference is made to the accompanying drawings, which form a part hereof, and in which is shown by way of illustration various embodiments in which the invention may be practiced. It is to be understood that other embodiments may be utilized and structural and functional modifications may be made without departing from the scope of the present invention.

I. General Description of Aspects of this Invention

1. Outsole Assembly for an Article of Footwear

Aspects of the invention relate to an outsole assembly for an article of footwear that is of a sufficient rigidity to provide stability and balance for a wearer during various athletic activities (e.g., firearm sports, archery). Articles of footwear according to at least some examples of the invention may include: (a) a shoe upper configured to receive a wearer's foot; and (b) an outsole assembly connected to the shoe upper, wherein the outsole assembly includes at least one layer comprising a material of a rigidity sufficient to resist bending of the outsole assembly due to a wearer's weight. A variety of materials may be used including fiberglass rigid thermoset plastics, other thermoplastic materials and/or metals such as titanium and/or steel. The rigidity of this at least one layer may be configured to improve the wearer's stability and balance despite shifts in weight and/or other causes of wearer instability or imbalance. In at least one or more configurations, the outsole assembly may include another layer disposed either above or below the rigid layer. The additional layer may comprise a foam and/or rubber material and may be configured to provide shock absorption, comfort, traction and the like. Alternatively or additionally, the additional layer may include a bladder impact force attenuation system. In yet at least one other configuration, the rigid layer of the outsole assembly may be sandwiched between two other layers (e.g., two foam/rubber layers) to improve various characteristics of the outsole.

The rigid layer may comprise various types of materials (e.g., carbon fiber material) and may be configured in various sizes and shapes depending on a wearer's preferences and needs. For example, a stiffer material may be required for a wearer weighing, e.g., over 300 pounds, than a material needed for a wearer weighing, e.g., less than 175 pounds. Alternatively or additionally, the thickness of the material may be defined to compensate for differences in the weight of different wearers. The rigid layer may, according to one or more aspects, be of a sufficient size to cover one or more areas of a wearer's foot that is subject to shifts in weight, bending and the like. In one or more arrangements, the size of the rigid layer may match the size of one or more other layers of the outsole assembly. Alternatively, the size of the rigid layer may smaller or greater than the size of other layers of the outsole assembly. In one example, an outsole assembly may include three layers, one of which comprising a rigid material such as a carbon fiber plate. A smaller rigid layer may be sandwiched between two foam and/or rubber layers that provide various types of support for the wearer. Furthermore, the length of the outsole assembly in general may be greater than the length of a connected shoe upper, where length is defined from toe to heel. Such a configuration may be used for articles of footwear designed for firearm competitions as the articles of footwear may be required to connect to another device.

The rigid layer may be positioned in a variety of areas of an outsole assembly so long as the rigid layer covers one or more portions of a wearer's foot that is subject to flexing, weight shifts and the like. For example, the rigid layer may be placed around the mid-foot region of the outsole assembly. The rigid layer may further include multiple pieces of the rigid material. That is, the rigid layer may be divided into multiple pieces rather than one integrally formed layer. Alternatively, the rigid layer may comprise a single integrally formed plate such as a carbon fiber plate.

As another example, articles of footwear according to this invention may include an outsole assembly comprising a layer configured to contact a walking surface, wherein the layer includes an enclosed channel to distribute a force to an outside portion of the outsole assembly. The channel may extend through the entire layer of the outsole assembly or a portion thereof and may, in one or more configurations, be entirely enclosed by the remainder of the layer. For example, an outsole assembly may include a foam or rubber material as a bottom layer of the outsole. A channel (e.g., of a circular shape) may be cut from the foam or rubber material such that a force applied to the outsole may be directed to the remaining portions of the bottom layer. The channel configuration of the outsole assembly may aid in the stability and balance of a wearer by diverting shifts in weight or other changes in a wearer's stance to more stable regions of the outsole. In one example, an outer edge region of an outsole may be subject to less variations in applied force due to the natural concentration of a wearer's weight in a more central region of a wearer's foot.

The channel may be a variety of shapes and sizes and be positioned in various areas of the outsole. According to one or more aspects, the channel may cover at least a mid-foot region of the outsole as the mid-foot region may be more susceptible to shifts in weight (e.g., back and force shifts) than other regions. The shape of the channel may depend on the desired distribution of force. For example, if more force is to be directed to a medial and lateral portion of the outsole, the channel may have an elongated oval shape (length of the oval extending substantially in the toe to heel direction). In one or more arrangements, the channel might not be fully enclosed by the remainder of the outsole layer. In particular, the channel may extend to one or more edges of the layer, again, depending on the desired distribution of weight.

As yet another example, an article of footwear may comprise both a rigid layer in the outsole assembly and a channel (e.g., in the rigid layer or another layer of the assembly). The use of both a rigid layer and the channel configuration may provide added stability and balance for various activities. Thus, a channel used in conjunction with a rigid layer may be of a smaller size than a channel used without a rigid layer to achieve the same amount of stability or balance. The channel may be formed in a bottom layer connected to the rigid layer and extend through the bottom layer and exposing the material forming the rigid layer. Alternatively, the channel may extend through both the bottom layer and the rigid layer.

2. Methods of Making and Using Outsole Assemblies According to the Invention

Further aspects of this invention relate to methods of making outsole assemblies having improved stability and balance systems and mechanisms. Such methods may include, for example, providing an outsole assembly to a shoe upper using, e.g., stitching, adhesives and/or other attachment means. The outsole assembly may be formed by initially creating each individual layer and combining the layers into a single outsole assembly using any of a variety of well-known attachment means. A rigid layer such as a carbon fiber layer may be formed using injection molding or various extrusion techniques known in the art. The carbon fiber may further be cut into a desired shape and size for the outsole assembly. One or more additional layers may be formed in similar fashion, e.g., a foam or rubber layer may be injection molded according to a desired shape and size. Alternatively, the foam or rubber layer may be molded in any size and subsequently cut to the desired configuration. A channel, if desired or needed, may be formed in a bottom layer at any time after formation of the bottom layer. For example, the channel may be cut into the bottom layer after the outsole assembly has been formed. Alternatively, the channel may be cut into the bottom layer prior to combining the layers to form the outsole assembly.

II. Detailed Description of Example Structures and Methods According to the Invention Specific examples of structures and methods according to the invention are described in more detail below. The reader should understand, however, that these specific examples are set forth merely to illustrate examples of the invention, and they should not be construed as limiting the invention.

FIG. 1 illustrates a shoe 100 including one example arrangement of an outsole assembly 200 in accordance with one or more aspects described herein. The shoe 100 generally includes an upper 105 configured to receive a wearer's foot, an insole (not shown), a midsole 115 and outsole assembly 200. The upper 105 may be composed of a breathable material to manage heat and odor. In addition, upper 105 may be lightweight to reduce the weight on a wearer's foot. Upper 105 may include various components including lacing system 120. Lacing system 120 may include multiple apertures 123 through which a lace 124 may extend. Apertures 123 may be holes, loops, slots, or any other suitable device for guiding and holding a lace 124. Lacing device 124 may include a conventional lace that is secured by tying, an elastic lace draw-cord with a slide closure for securing the shoe to the foot and the like. Upper 105 includes different types of apertures 123 for a foot portion 115 and a leg portion 116. In particular, foot portion 115 includes apertures 123*a* consisting of holes through which lace 124 extends. Leg portion 115 of upper 105, however, includes apertures 123*b* consisting of hooks. One of ordinary skill in the art will appreciate that various combinations of aperture types may be used.

In addition to lacing system 120, upper 105 includes a wrapping securing mechanism 130 that provides an additional level of security. Wrapping mechanism 130 includes a wrapping member 132 that extends around a rear of the upper 105 and extends through multiple receiving apertures 134. A first securing end 137 of wrapping member 132 is configured to wrap around receiving aperture 134*a* and to attach to itself via a VELCRO® attachment system (not shown). In order to tighten or loosen the wrapping securing mechanism 130, more or less, respectively, of the wrapping member 132 may be extended through receiving aperture 134*a*. Wrapping securing mechanism 130 may be located in an upper portion of upper 105, e.g., approximately around a wearer's ankle. Alternatively or additionally to the upper securing mechanisms 120 and 130 discussed above, other types of securing systems may also be used, including VELCRO®, zipper arrangements, belt systems and the like.

Upper 105 may further be composed of multiple materials. For example, various portions of upper 105 may be composed of a leather material while other portions may consist of a cloth fabric or plastic material. Certain materials may be included for their functional aspects such as rubber for waterproofing and fabrics for breathability. Similarly, a more rigid material may be used in forming a portion of upper 105 to resist flexion or deformation of that area (e.g., to prevent twisting an ankle or other foot related injuries). In one or more embodiments, upper 105 may be composed of thermally insulative materials to protect a wearer's feet during cold weather.

Further to FIG. 1, an insole (not shown) may be connected to midsole 115, which may be connected to outsole assembly 200. The insole may be placed within upper 105 and be connected to midsole 115 through a variety of attachment mechanisms including adhesives, stitching and the like. Midsole 115 does not span the entire length of shoe 100 and instead, extends approximately two-thirds of the way toward a toe portion of upper 105. In one or more configurations, midsole 115 may span the entire length of shoe upper 105. Midsole 115 may consist of a rubber or foam material to provide impact force attenuation and support. Midsole 115 may, alternatively or additionally, include a bladder type support mechanism that provides impact force attenuation and shock absorption.

Outsole assembly 200 includes three layers 205, 210 and 215. Each of layers 205, 210 and 215 are visible from the sides of shoe 100. Layers 205 and 215 include a rubber or foam material that provides impact force attenuation and traction (in the case of layer 215). The material of layers 205 and 215 may be more rigid than typical outsole materials to provide further balance and stability. In the configuration shown in FIG. 1, top layer 205 is thicker than both bottom layer 210 and rigid layer 210. Rigid layer 210 includes a material such as a carbon fiber plate having a predefined rigidity. The rigidity may be defined based on various factors including terrain on which shoe 100 will be used, weight of the wearer, size of the shoe and/or combinations thereof. As depicted, the length of outsole assembly 200 is greater than the length of upper 105. As discussed, this difference in length is provided to allow a wearer to attach shoe 100 to another device (not shown) via the outsole assembly 200. Additionally, the width of outsole assembly 200 is also be slightly greater than the width of upper 105 to provide added stability in a lateral direction (e.g., to stabilize any potential side-to-side movement or shift in weight). The thickness of rigid layer 210 depends on the rigidity of the material used in layer 210 as well as the preferences and/or needs of the ultimate wearer. For example, some wearers might prefer a shoe with some flexibility while other wearers may prefer a shoe with no flexibility at all.

Figure 2:
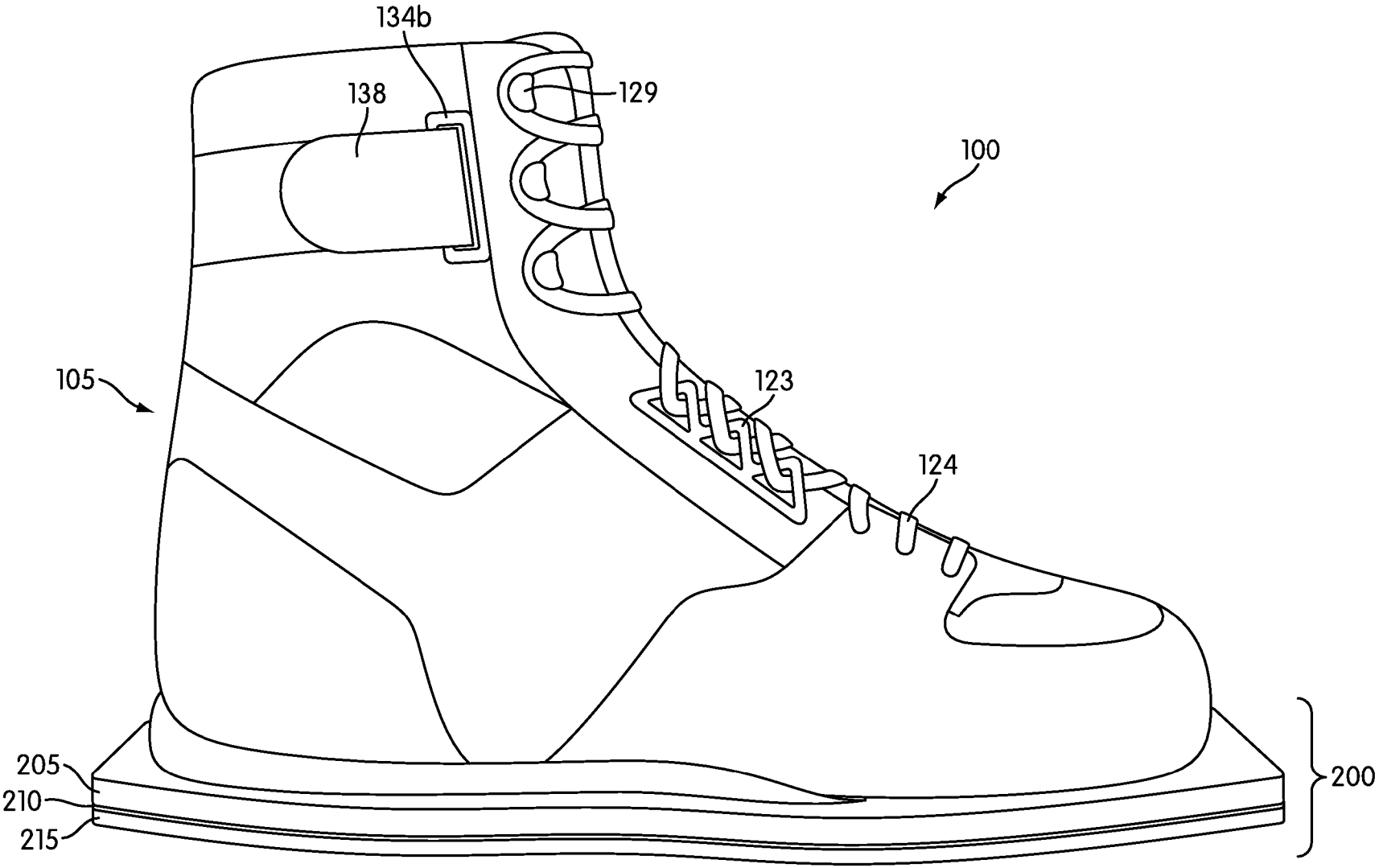
FIG. 2 is medial side view of the article of footwear of FIG. 1.

FIG. 2 is a medial side view of shoe 100. In the view of FIG. 2, a second receiving aperture 134*b* where a second securing end 138 of wrapping member 132 is received.

Second securing end 138 wraps around aperture 134*b* and attaches to itself via a VELCRO® attachment mechanism. Additionally, upper 105 includes a second set of apertures 129 through which lace 124 extends. Lace 124 may extend between apertures 123 and 129 by, e.g., criss-crossing over the top of a front portion of shoe 100. The medial side of shoe 100 may be composed of substantially the same materials as the lateral side of shoe 100. The various layers 205, 210 and 215 of outsole assembly 200 are also visible from the medial side.

Figure 3:
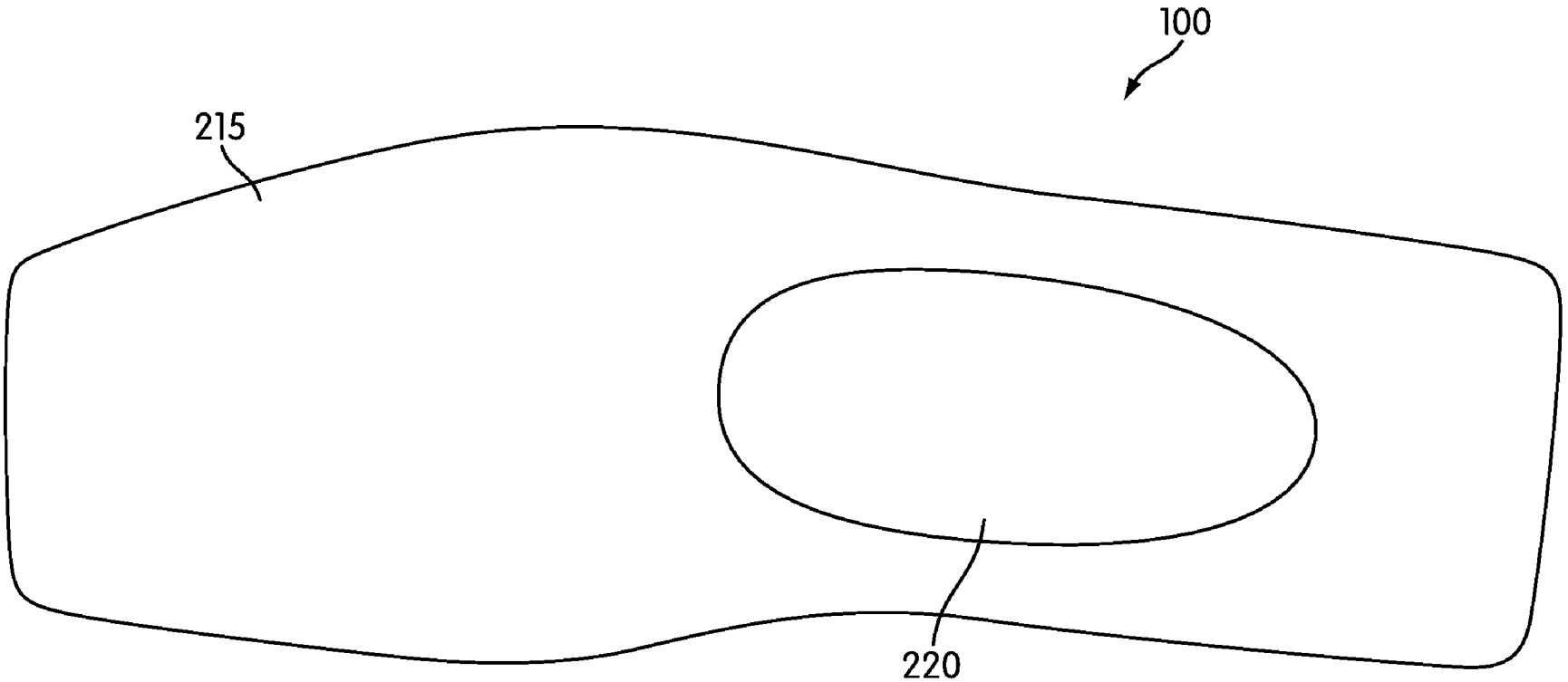
FIG. 3 is a plan view of the bottom of the outsole assembly of FIG. 1.

FIG. 3 is a bottom view of shoe 100 showing a bottom surface of outsole assembly 200 and a portion of rigid layer 210 exposed through channel 220 of layer 215. As illustrated in FIG. 3, the surface of bottom layer 215 may include one or more traction elements 220 such as ridges to aid a wearer in maintaining stability and grip. The traction elements 220 may form one or more patterns to further improve grip and thus, traction, on a given surface. For example, the ridges may form a zig-zag pattern or the like. Traction elements 220 may vary in size (e.g., height) and/or shape depending on an intended use and/or the region of a wearer's foot to which the elements 220 correspond. For example, traction elements in a heel region of the outsole may be larger than traction elements in a toe region due to the differential in weight concentration between the two regions. Traction elements 220 may also be different shaped depending on a surface on which shoe 100 is used. Grass surfaces, for example, may require spike elements for better traction. Additionally or alternatively, traction elements 220 may be composed of different materials. In one example, some of traction elements 220 may be formed of metal while others may be formed of a plastic material.

The shape of bottom layer 215 and outsole assembly 200 in general may correspond to a shape of shoe upper 105. That is, the shape of shoe upper 105 may define the shape and size of a bottom surface of layer 215 and outsole assembly 200. In FIG. 3, the lateral edges of layer 215 may substantially follow the lateral shape (e.g., a curvature) of shoe upper 105. Layer 215, however, may be wider than shoe upper 105 to provide stability in the lateral direction. In a longitudinal direction (i.e., defined by the axis extending between a toe portion and a heel portion of outsole assembly 200), layer 215 may be longer than shoe upper 105. In addition to providing added stability and balance, the length of layer 215 and of outsole assembly 200 in general allows for the attachment of shoe 100 to a device for maintaining the shape and configuration of shoe 100 (e.g., maintaining the flatness of outsole assembly 200). In particular, the portion of outsole assembly 200 extending past shoe upper 105 may act as a clamping region for the device. In one or more arrangements, outsole assembly 200 and layer 215 might not include an attachment region due to the ability of rigid layer 210 to maintain the flatness and overall shape of outsole assembly 200.

According to one or more aspects, bottom layer 215 may consist of multiple pieces. That is, if the bottom layer 215 is formed of a rubber material, multiple individual pieces of rubber may be used to form the bottom layer 215 to save costs and material while achieving the same level of stability and balance. The individual pieces may be shaped and positioned in regions of outsole assembly 200 to compensate for those areas that are particularly susceptible to instability and/or imbalance (e.g., a mid-foot region).

Figure 12A:
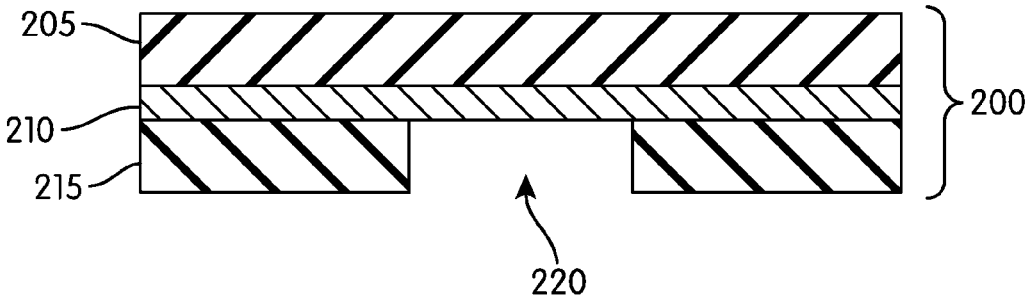
FIGS. 12A and 12B illustrate example cross-sectional views of an oustsole assembly layer having a channel formed therein according to aspects described herein.
Figure 12B:
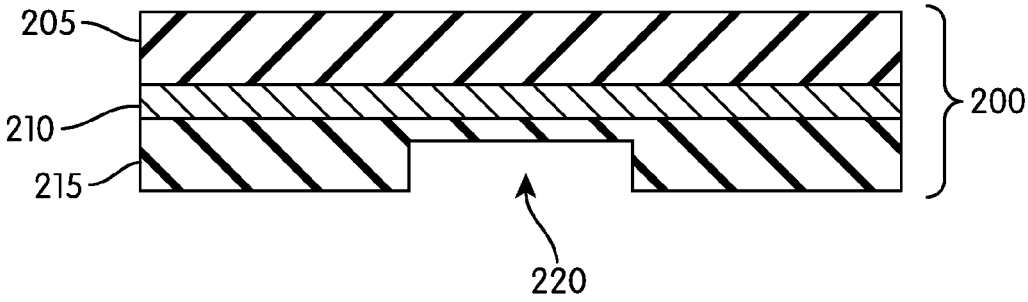

According to the illustrative embodiment of FIG. 3, channel 220 is a cut-out of bottom layer 215. Additionally, channel 220 is entirely enclosed by a remainder of bottom layer 215. By creating channel 220, a force that would otherwise act on the material removed to create channel 220 is distributed to the remainder of bottom layer 215. In the configuration of FIG. 3, channel 220 causes the weight or force to be distributed toward an outside region of layer 215, thus stabilizing a wearer's stance and providing improved balance. The depth of channel 220 may depend on the thickness of outsole assembly 200. That is, the depth of channel 220 may be limited by the total thickness of outsole assembly 200. Additionally, channel 220's depth may also be limited to a threshold depth at which a distribution of force away from channel 220 may cause bending of shoe 200 (i.e., the shoe may bend upward at the toe and heel portions) and thus, instability. Thus, channel 220's depth may be less than the thickness of bottom layer 215, depending on the thickness thereof. Channel 220 may further be provide aesthetic advantages, e.g., by exposing a portion of rigid layer 210. FIG. 12A illustrates an embodiment in which depth of channel 220 is identical to the thickness of bottom layer 215, thereby exposing the bottom of rigid layer 210. FIG. 12B illustrates another embodiment in which the depth of channel 220 is less than the thickness of bottom layer 215.

Figure 5A:
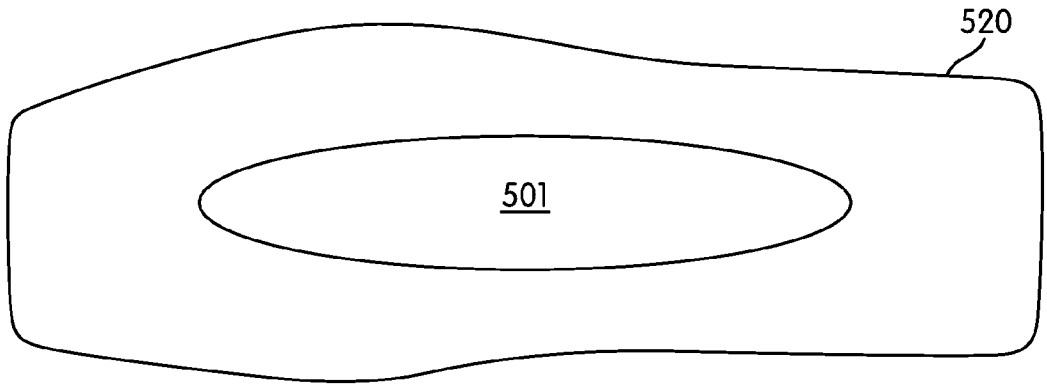
FIG. 5A is an outsole assembly having an alternative channel configuration.
Figure 5B:
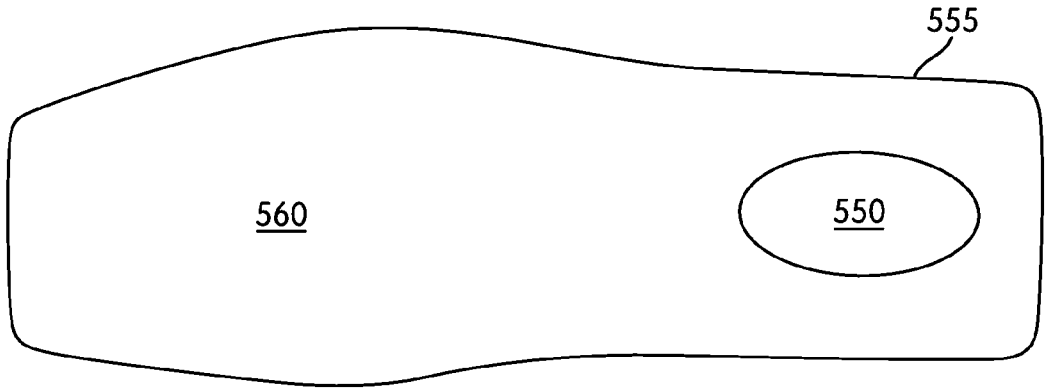
FIG. 5B is an outsole assembly having another alternative channel configuration.
Figure 5C:
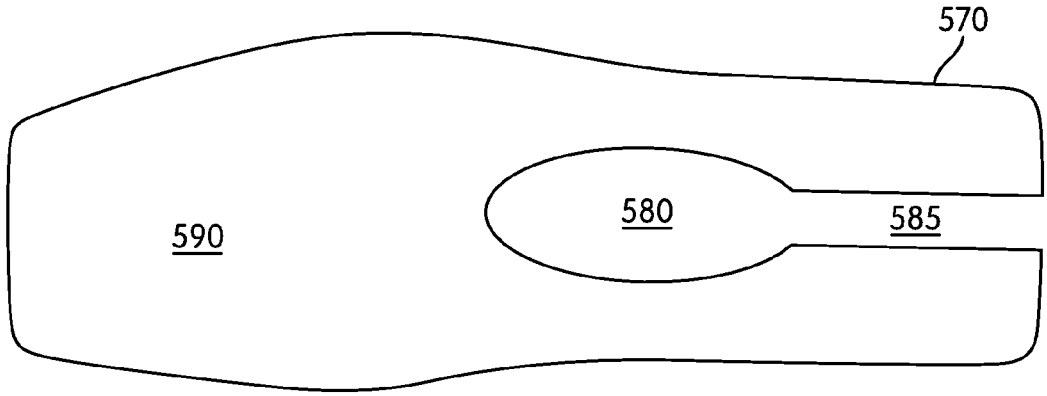
FIG. 5C is an outsole assembly having yet another alternative channel configuration.

As discussed, channel 220 may be formed according to a variety of configurations. FIGS. 5A-C illustrate various configurations of a channel in an outsole assembly without a rigid layer. For example, FIG. 5A illustrates an enclosed elongated oval channel 501 disposed along the length of outsole assembly 500. The increased length of channel 501 (as compared to the length of channel 220) provides distribution of weight along a greater length of outsole assembly 520. That is, weight or force applied toward a toe region of outsole assembly 520 is also distributed using the configuration of FIG. 5A. FIG. 5B illustrates a channel 550 in outsole assembly 555 that is limited to a heel region. Accordingly, weight or force applied in a heel region of outsole assembly 555 may be distributed toward the remainder of bottom layer 560. However, in contrast to the configuration of FIG. 5A, a weight or force applied to a toe or mid-foot region of outsole assembly 555 might not be similarly distributed. The position, shape and size of channels in outsole assemblies may depend, in part, on the use of the article of footwear and, in particular, the region or regions where weight or force is concentrated.

Furthermore, complete enclosure of a channel is not required. Various portions of the channel might not be enclosed to prevent weight from being distributed in the direction of that region. FIG. 5C for example, illustrates an outsole configuration of outsole assembly 570 where channel 580 is not entirely enclosed by layer 590. Thus, weight might not be distributed in the direction of region 585 where channel 580 is not enclosed by layer 590 since no supporting material exists in that direction (i.e., there is no material to which to distribute the weight). Depending on the uses of a shoe, a channel may be required to be enclosed to some degree. Thus, in various embodiments, at least ¼, ½, or ¾ of a channel may be enclosed by a surrounding outsole layer. Additionally, the portion of a channel that is enclosed or is not enclosed may depend on the typical stance or weight distribution of a wearer.

Figure 4:
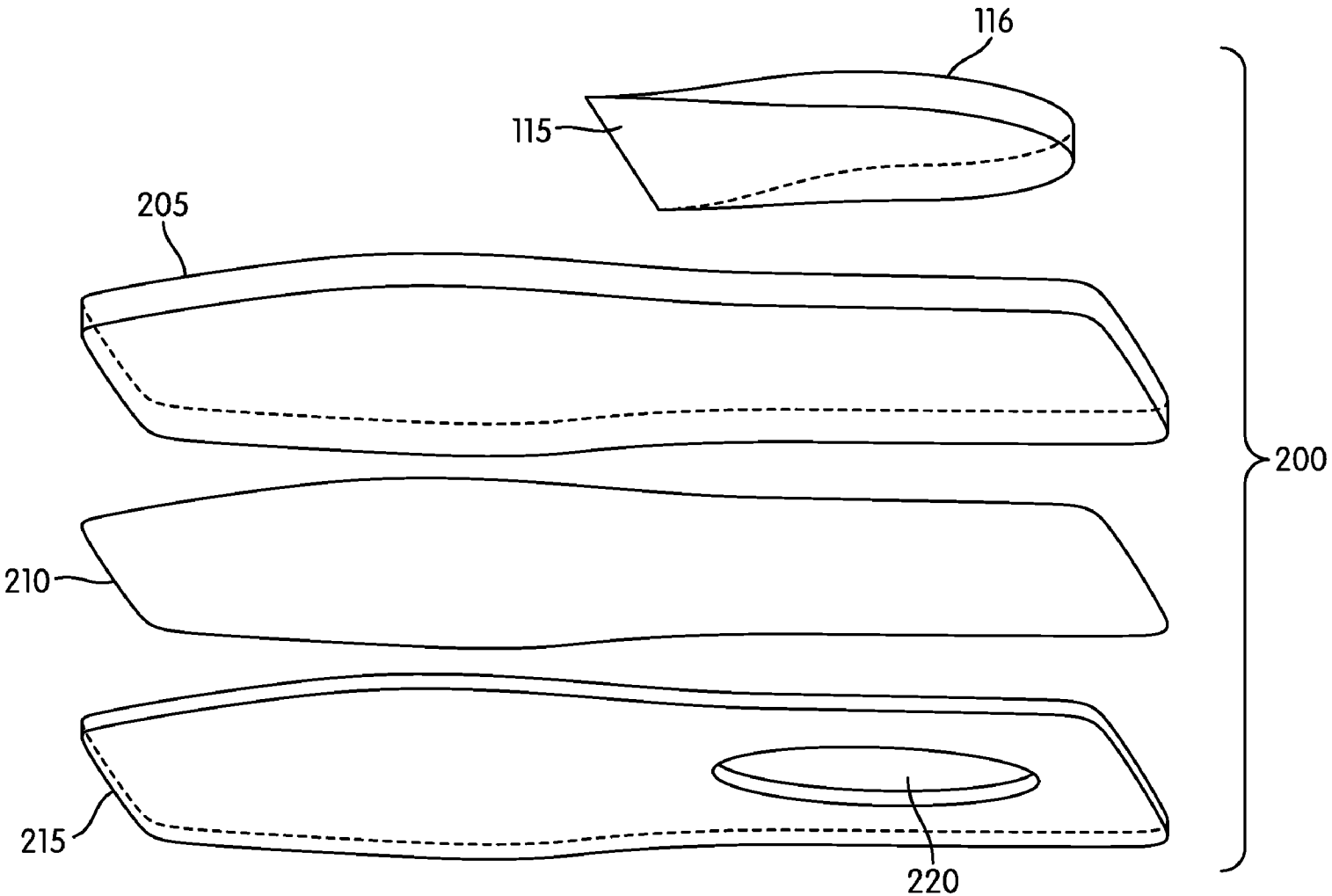
FIG. 4 is an exploded view of the outsole assembly of FIG. 1.

FIG. 4 is an exploded view of a sole assembly of FIG. 1. In particular, layers 205, 210 and 215 of outsole assembly 200 are shown separated from one another. As discussed, bottom layer 215 includes channel 220. Specifically, channel 220 extends through bottom layer 215 creating an opening in layer 215. Layer 210 may consist of a rigid plate (e.g., composed of a carbon fiber material) that is shaped substantially similarly to layers 210 and 205. Layer 210 does not include a channel and thus, is partially exposed through channel 220 in bottom layer 215 when assembled. Top layer 205 is formed of the same material as layer 210 and is slightly thicker than layer 210 to provide comfort and impact force attenuation for a wearer's foot above rigid layer 210. The layers 205, 210 and 215 may be assembled using chemical adhesives or stitching or stapling or other mechanical systems. Layers 205, 210 and 215 may be assembled such that the edges of each of layers 205, 210 and 215 are aligned.

Midsole 115 is illustrated in FIG. 4 as a curved concave member having upward extending portions 116 and configured to receive shoe upper 105 (not shown in FIG. 4). Midsole 115 wraps around the bottom of shoe upper 105 and helps connect outsole assembly 200 to shoe upper 105. Midsole 115 extends approximately two-thirds of the length of shoe upper 105 and outsole assembly 200. Thus, in assembling midsole 115, outsole assembly 200 and shoe upper 105, a heel and mid-foot region of the outsole assembly 200 may be connected to shoe upper 105 via midsole 115 while a toe and forefoot region of the outsole assembly 200 may be connected directly to shoe upper 105. Midsole 115 may be attached to outsole assembly 200 and/or shoe upper 105 using chemical adhesives, stitching, stapling and the like. For example, upward extending portions 116 of midsole 115 may be stitched to a side portion of shoe upper 105.

Figure 6:
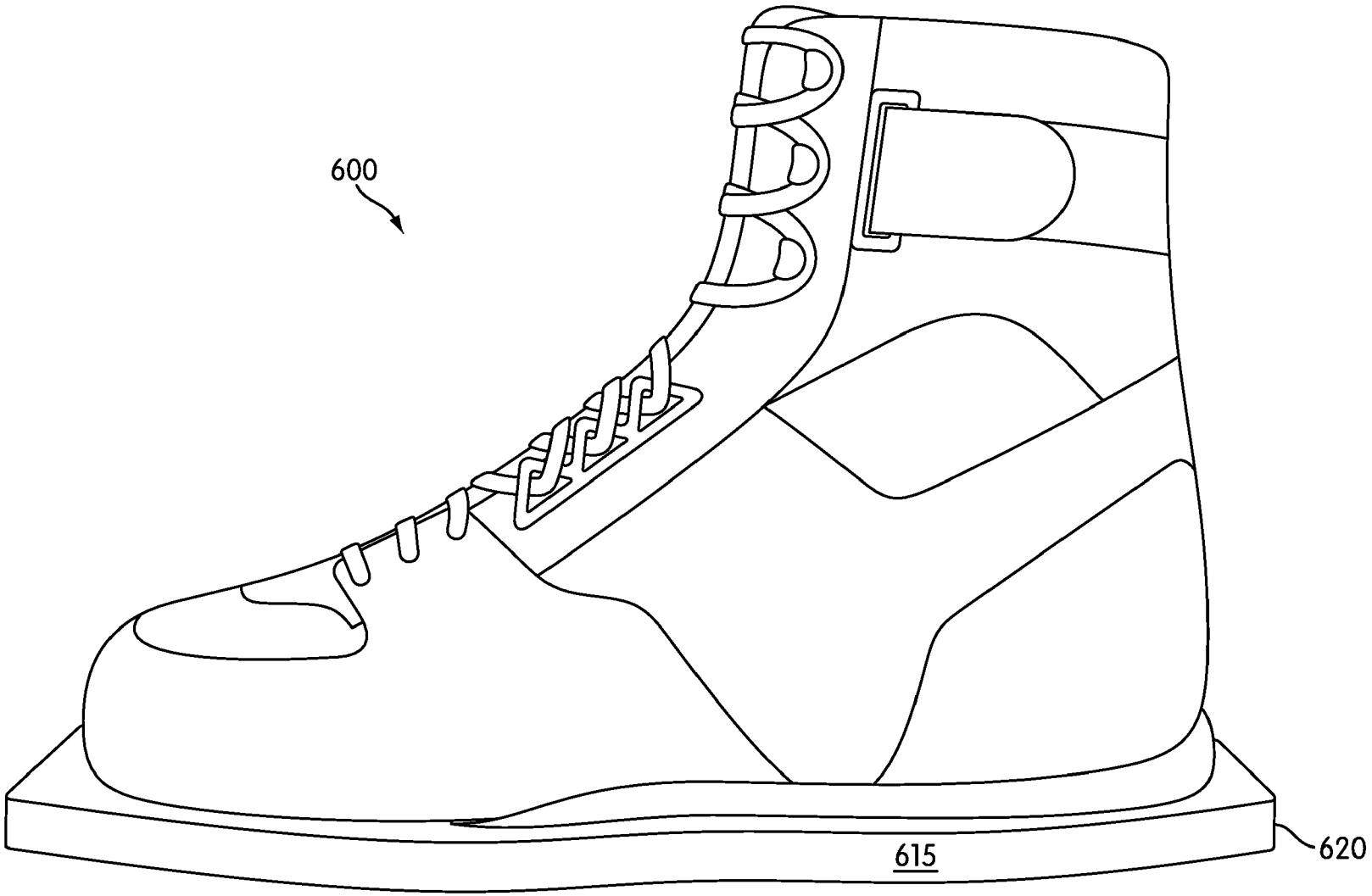
FIG. 6 is a lateral side view of an article of footwear with a rigid outsole assembly according to another embodiment.
Figure 13A:
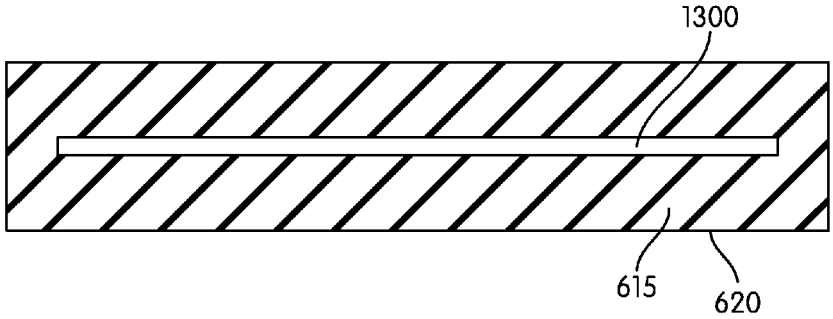
FIG. 13A is a lateral cross-sectional view of the outsole assembly according to the embodiment of FIG. 7 without the rigid layer.
Figure 13B:
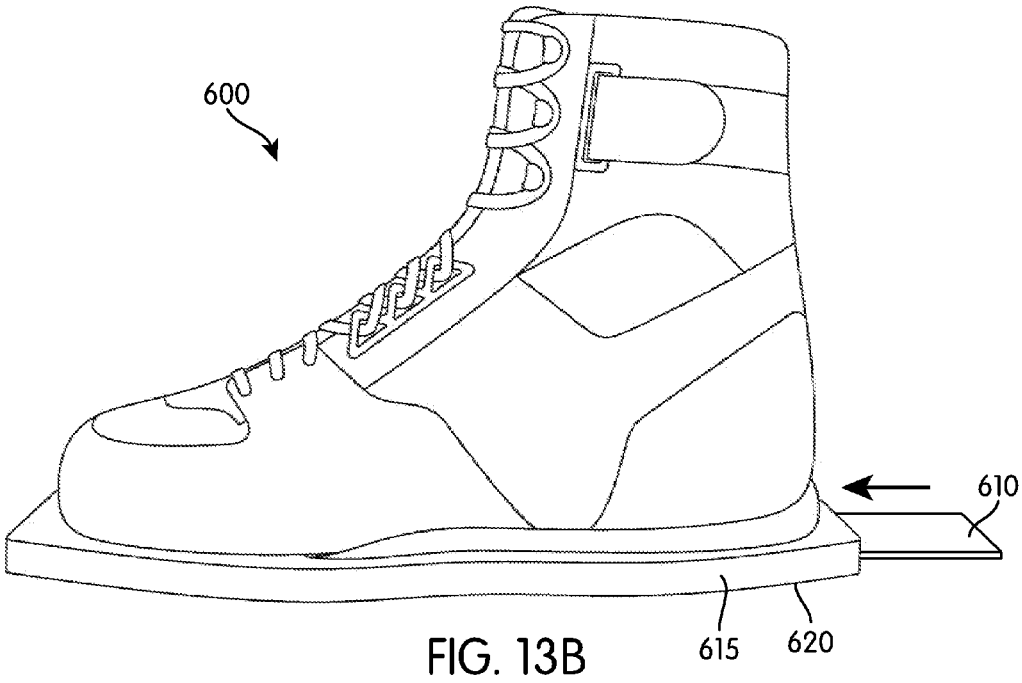
FIG. 13B is a lateral side view of an article of footwear with an outsole assembly having an insertable rigid layer.

FIG. 6 illustrates a lateral side view of a shoe 600 having an outsole assembly 620 in an alternate arrangement. In particular, a rigid layer (not shown) is encased in a second layer 615. The second layer 615 may be a foam, rubber or plastic material that provides some shock absorption and/or impact force attenuation to enhance a wearer's comfort. Encasing the rigid layer may help protect accidental cuts or injuries resulting from an exposed sharp edge of the rigid layer. As shown in FIG. 13A, the rigid layer 610 may be placed within second layer 615 by forming the second layer 615 with an opening and an internal cavity 1300 configured to receive the rigid layer 610 (e.g., a carbon fiber plate). Accordingly, as shown in FIG. 13B, a rigid material, such as rigid layer 610, may be inserted into the second layer 615 post-fabrication. Alternatively, rigid layer may be composed of a plurality of pieces that are assembled together. In one example, layer 615 may include a top piece and a bottom piece that are attached together once a rigid material forming the rigid layer has been inserted therebetween.

An insertable rigid layer may also enhance the flexibility of shoe 600's uses. That is, in firearm activities, for example, a user may insert the rigid layer into shoe 600 to provide added stability and balance. However, during other activities such as jogging or walking, the rigid layer may be removed from second layer 615 for added comfort and impact force attenuation. Different types of rigid layers may also be used interchangeably depending on a surface associated with the activity (e.g., grass versus cement). Alternatively or additional outsole devices may also be designed for insertion into layer 615 including bladders and other padding materials. In the example discussed above relating to layer 615 including a top piece and a bottom piece, the bottom piece may be detachable from the remainder of outsole assembly 620. In particular, the bottom piece may be attached to the top piece or the remainder of outsole assembly 620 using a detachable or disengageable attachment mechanism such as a latch, a peg/hole arrangement (e.g., pegs protruding from the bottom piece may be inserted into holes in the top piece) and the like.

Figure 7:
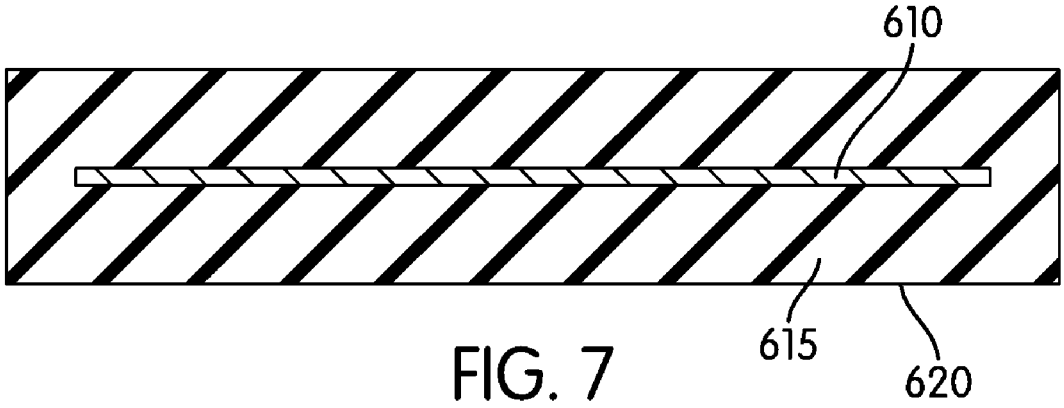
FIG. 7 is a lateral cross-sectional view of the outsole assembly according to the embodiment of FIG. 5.

FIG. 7 is a lateral cross-sectional view of outsole assembly 620 of FIG. 6 taken along a mid-foot region. The cross-sectional view shows that outsole assembly 620 includes a rigid layer 610 encased by a second layer 615. The thickness and width of each respective layer, layers 610 and 615, may depend on the amount of rigidity and/or impact force attenuation/support that is desired or needed by the wearer. In one or more embodiments, the width of rigid layer 610 may extend at least ½ the width of layer 615 or outsole assembly 620. Alternatively, rigid layer 610 may extend at least ⅔, ¾ or ⅞ of the width of layer 615 and/or outsole assembly 620. Additionally or alternatively, the cross-sectional area of rigid layer 610 may be configured according to various shapes. For example, a thickness of rigid layer 610 may vary between a first thickness T1 around the edges 1500 of layer 610 to a second thickness T2 toward the middle 1502 of layer 610. The second thickness T2, in one or more instances, may be greater than the first thickness T1 to provide additional rigidity and stability to an interior region of a wearer's foot.

Figure 8:
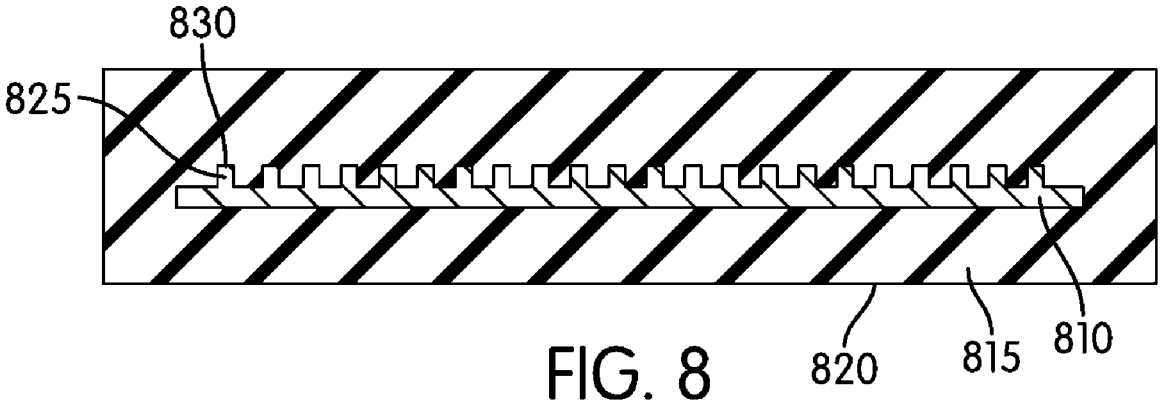
FIG. 8 is a lateral cross-sectional view of an outsole assembly according to another alternative embodiment.

According to one or more aspects, a rigid layer may include one or more protruding members to secure the rigid layer to a remainder of the outsole assembly. FIG. 8 is a cross-sectional view of an outsole assembly 820, wherein rigid layer 810 includes a plurality of protrusions 825. Additionally, layers 805 and 815 include a plurality of recesses 830 that are configured to match up with and receive protrusions 825. Securing rigid layer 810 to one or more of layers 805 and 815 may prevent slippage of the rigid layer 810 into unintended regions of the outsole assembly 820. For example, if a rigid layer 810 is meant to provide rigidity in a mid-foot region, slippage of layer 810 may frustrate the intended purpose of layer 810. Protrusions 825 and recesses 830 may further act as an attachment mechanism for attaching rigid layer 810 to a remainder of outsole assembly 820.

Figure 9:
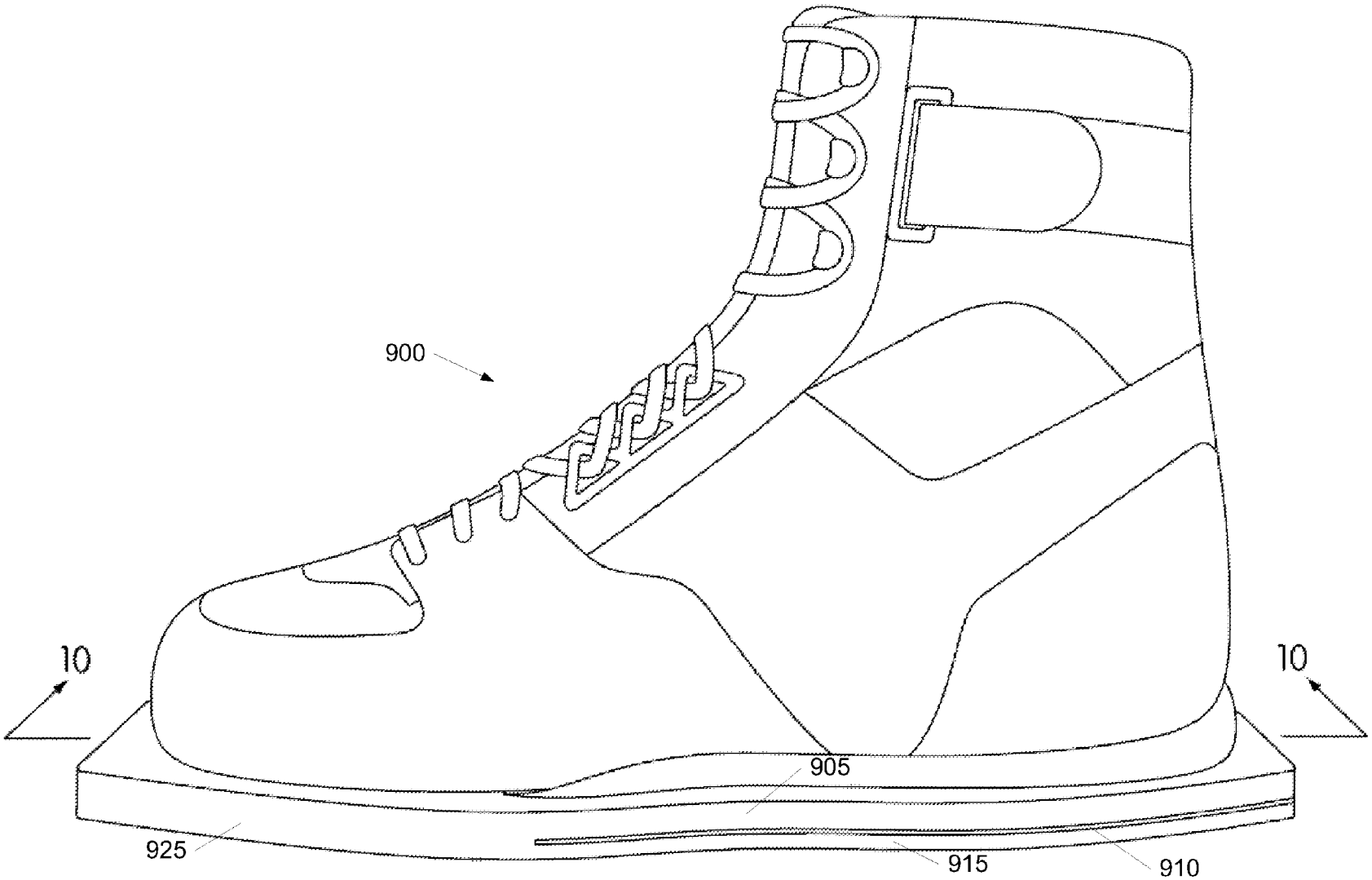
FIG. 9 is a lateral side view of an article of footwear having a rigid layer that extends through a portion of the outsole.

FIG. 9 illustrates shoe 900 having a rigid layer that does not extend the entire length of shoe 900. Rigid layer 910 may extend from a heel or back portion of shoe 900 and end around a region of outsole assembly 920 corresponding to a ball of a wearer's foot. This configuration may provide some flexibility for a wearer's forefoot while still providing stability and balance in the heel or rear area of shoe 900. The forefoot portion 925 of outsole assembly 920 may be composed entirely out of a flexible material such as a foam/rubber material used for layers 905 and 915. According to one or more embodiments, layers 905 and 915 may be integrally formed. Various other materials may also be used provided the other materials allow for flexion of a wearer's forefoot.

Figure 10:
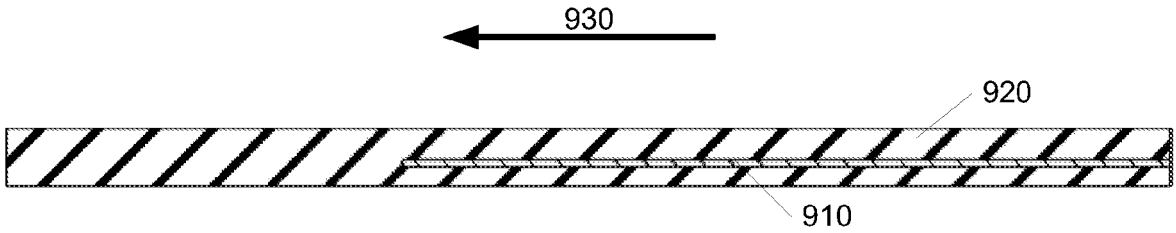
FIG. 10 is a cross-sectional view of the article of footwear of FIG. 9 along a longitudinal axis defined from the toe to the heel of the article of footwear.

FIG. 10 is a cross-sectional view of outsole assembly 920 along a longitudinal axis from the toe to the heel of shoe 900 (FIG. 9). As illustrated, rigid layer 910 extends through the entire heel region of shoe 900 but does not extend beyond a ball area of shoe 900 in a forefoot direction (indicated by arrow 930). Forefoot region 925 is composed of a flexible material beyond the point at which rigid layer 910 ends. The degree to which rigid layer 910 extends through the outsole assembly 920 may depend on the particular use of shoe 900. For example, in some firearm sports (e.g., rifle shooting), flexibility may be needed in the forefoot region while in other firearm sports (e.g., pistol shooting), flexibility in the forefoot region might not be as imperative. Accordingly, the shape and size of rigid layer 910 may vary accordingly.

Figure 11:
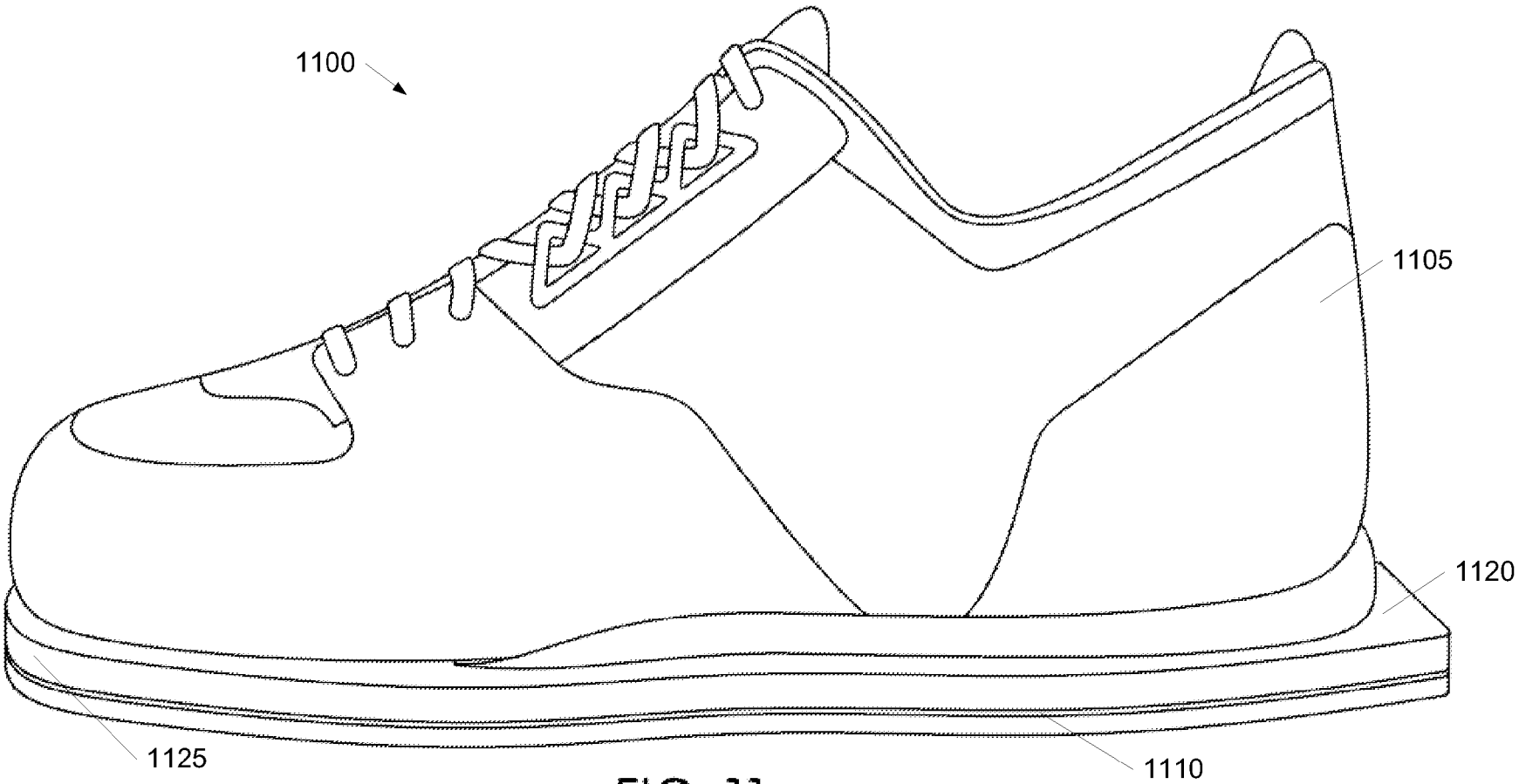
FIG. 11 is a lateral side view of an article of footwear with a rigid outsole assembly according to an alternative illustrative embodiment.

An article of footwear according to the various aspects described herein may be configured in a variety of styles and shapes. For example, FIG. 11 illustrates a shoe 1100 having a low-top upper 1105 and a rounded toe outsole assembly 1120, wherein the rounded toe outsole assembly 1120 includes rigid layer 1110. Low-top upper 1105 may be used for sporting events that may require, in one or more instances, more freedom of movement in the ankle area. Further, toe area 1125 of outsole assembly 1120 may be rounded where rigid layer 1110 extends through the entire outsole assembly 1120 thereby reducing the need for a stretcher device (i.e., the rigid layer 1110 provides the tension force needed to keep the outsole flat). Thus, without a need for a stretcher device, toe area 1125 of outsole assembly 1120 might not require an area for attachment.

While various aspects and features have been described in large part with respect to articles of footwear for firearm activities, the concepts described herein may also be used for other activities and events that require improved balance and stability in a wearer's stance or stride. Further, while only one rigid layer is discussed in the embodiments described herein, multiple rigid layers may be used. For example, two rigid layers may be used in combination with three force attenuation or other layers (i.e., each rigid layer would be sandwiched between two other non-rigid layers).

III. Conclusion

While the invention has been described in detail in terms of specific examples including presently preferred modes of carrying out the invention, those skilled in the art will appreciate that there are numerous variations and permutations of the above described systems and methods. Thus, the spirit and scope of the invention should be construed broadly as set forth in the appended claims.

What is claimed is:

1. An article of footwear comprising:

an upper configured to receive a wearer's foot; and an outsole assembly connected to the upper, the outsole assembly having a length greater than a length of the upper such that the outsole assembly extends beyond the upper in a longitudinal direction at a toe region and a heel region, the outsole assembly further having a width greater than a width of the upper such that the outsole assembly extends beyond the upper in a lateral direction at a lateral side and a medial side, the outsole assembly including:

a first layer of a first rigidity configured to provide impact force attenuation; and a second layer of a second rigidity greater than the first rigidity, wherein the second rigidity is sufficient to substantially resist flexion of the outsole assembly in both the longitudinal direction and the lateral direction, wherein the first layer extends continuously in the longitudinal direction along the length of the outsole assembly and extends continuously in the lateral direction across the width of the outsole assembly;

wherein the second layer extends continuously in the longitudinal direction along the length of the first layer from beyond the heel region of the upper to at least a mid-foot region of the upper, wherein at least a portion of the second layer extends continuously in the lateral direction across substantially the entire width of the first layer from the lateral side to the medial side;

wherein a shape of at least a portion of the outsole assembly extending beyond the upper along the longitudinal direction at the toe region and the heel region is different than a shape of the upper at the toe region and the heel region;

wherein the outsole assembly further comprises a third layer of a third rigidity, wherein the second rigidity is greater than the third rigidity;

wherein the second layer is disposed between the first layer and the third layer;

wherein the third layer has a first portion disposed through the toe region of the outsole assembly that is associated with a first thickness throughout the entire toe region;

wherein the third layer has a second portion disposed through the mid-foot region and the heel region that is associated with the first thickness; and wherein the outsole assembly further comprises a channel disposed through the mid-foot region and the heel region of the third layer, the channel being defined by an opening in the third layer that has a depth equal to the first thickness.

2. The article of footwear of claim 1, wherein the second layer comprises a carbon fiber material.

3. The article of footwear of claim 2, wherein the first layer comprises a rubber material.

4. The article of footwear of claim 1, further comprising a midsole connecting the outsole assembly to the upper.

5. The article of footwear of claim 1, wherein the portion of the outsole assembly extending beyond the upper at the toe region and the heel region has a rectangular shape.

6. The article of footwear of claim 5, wherein the outsole assembly includes means to attach to a stretcher device for maintaining the outsole assembly in a flattened condition.

7. The article of footwear of claim 1, wherein the second layer includes one or more protrusions and the first layer includes one or more recesses configured to receive said one or more protrusions of the second layer.

8. The article of footwear of claim 1, wherein the third rigidity is the same as the first rigidity.

9. An outsole assembly for an article of footwear including an upper, the outsole assembly comprising:

a first layer of a first rigidity configured to provide impact force attenuation; and a second layer of a second rigidity greater than the first rigidity, wherein the second rigidity is sufficient to substantially resist flexion of the outsole assembly in both longitudinal and lateral directions, and wherein the outsole assembly is configured to have a length greater than a length of the upper associated with the article of footwear such that the outsole assembly is configured to extend beyond the upper in a longitudinal direction at a toe region and a heel region, the outsole assembly further configured to have a width greater than a width of the upper such that the outsole assembly is configured to extend beyond the upper in a lateral direction at a lateral side and a medial side;

wherein the second layer extends longitudinally from the heel region of the first layer to at least a mid-foot region of the first layer, wherein at least a portion of the second layer extends continuously in the lateral direction across substantially the entire width of the first layer from the lateral side to the medial side;

wherein the outsole assembly extending beyond the upper at the heel region has a rectangular shape;

wherein the outsole assembly further comprises a third layer of a third rigidity, wherein the second rigidity is greater than the third rigidity;

wherein the second layer is disposed between the first layer and the third layer;

wherein the third layer has a first portion disposed through the toe region of the outsole assembly that is associated with a first thickness throughout the entire toe region;

wherein the third layer has a second portion disposed through the mid-foot region and the heel region that is associated with the first thickness; and wherein the outsole assembly further comprises a channel disposed through the mid-foot region and the heel region of the third layer, the channel being defined by an opening in the third layer that has a depth equal to the first thickness.

10. The outsole assembly of claim 9, wherein the second layer comprises a carbon fiber material.

11. The outsole assembly of claim 10, wherein the first layer comprises a rubber material.

12. The outsole assembly of claim 9, wherein the outsole assembly includes means to attach to a stretcher device for maintaining the outsole assembly in a flattened condition.

13. The outsole assembly of claim 9, wherein the outsole assembly extending beyond the upper at the toe region has a rounded shape.

14. The outsole assembly of claim 9, wherein the second layer includes one or more protrusions and the first layer includes one or more recesses configured to receive said one or more protrusions of the second layer.

15. The outsole assembly of claim 9, wherein the third rigidity is the same as the first rigidity.

* * * * *